US007101241B2

(12) United States Patent
Monroe

(10) Patent No.: US 7,101,241 B2
(45) Date of Patent: Sep. 5, 2006

(54) FLOATATION APPARATUS AND METHOD

(76) Inventor: Kenneth R. Monroe, P.O. Box 14, Schuylerville, NY (US) 12871

( * ) Notice: Subject to any disclaimer, the term of this patent is extended or adjusted under 35 U.S.C. 154(b) by 0 days.

(21) Appl. No.: 10/237,366

(22) Filed: Sep. 6, 2002

(65) Prior Publication Data

US 2004/0048530 A1 Mar. 11, 2004

(51) Int. Cl.
*A63B 21/008* (2006.01)
*A63B 69/00* (2006.01)

(52) U.S. Cl. ..... 441/129; 482/111

(58) Field of Classification Search ..... D21/678, D21/679–685, 801, 803–810; 440/101; 441/56, 441/59, 88, 106, 125–128, 126, 129, 130–132; 482/106–108, 111–113
See application file for complete search history.

(56) References Cited

U.S. PATENT DOCUMENTS 1,349,891 A * 8/1920 Kuznetzoff ..... 440/27
1,752,630 A 4/1930 Brown
2,009,551 A * 7/1935 Huebner ..... 441/56
2,941,219 A * 6/1960 Irving ..... 441/56
3,231,270 A * 1/1966 Winer ..... 482/106
3,336,029 A * 8/1967 London ..... 463/47.2
3,425,072 A * 2/1969 Carlson ..... 441/114
4,076,236 A * 2/1978 Ionel ..... 482/108
4,089,528 A * 5/1978 Green ..... 482/106
4,199,140 A * 4/1980 Ferretti ..... 482/106
4,302,194 A * 11/1981 Perales ..... 440/13
4,361,324 A * 11/1982 Baroi ..... 482/108
D271,408 S * 11/1983 Bauer ..... D21/681
4,443,204 A * 4/1984 Perrin ..... 441/129
4,565,369 A * 1/1986 Bedgood ..... 482/111
4,623,142 A * 11/1986 MacKechnie ..... 482/111
4,722,329 A 2/1988 Kalvag
4,768,774 A 9/1988 Beasley
4,798,550 A 1/1989 Biancucci
4,824,411 A 4/1989 McClanahan
4,905,992 A * 3/1990 McWain ..... 482/106
4,913,422 A * 4/1990 Elmore et al. ..... 482/106
4,993,980 A 2/1991 Dulin et al.
4,997,184 A * 3/1991 Sherman ..... 482/108
5,033,739 A * 7/1991 MacKechnie ..... 482/111
5,114,371 A * 5/1992 Alonzo ..... 441/129
5,184,993 A * 2/1993 Dowdeswell ..... 482/106
5,203,753 A * 4/1993 Rothhammer ..... 482/111
5,266,069 A * 11/1993 Thorne ..... 482/111
5,295,884 A * 3/1994 Whiteley ..... 441/122
5,385,497 A 1/1995 Chu
5,391,133 A * 2/1995 Ruffa ..... 482/92

(Continued)

FOREIGN PATENT DOCUMENTS

DE 2948957 A * 6/1981

(Continued)

OTHER PUBLICATIONS

Sprint Aquatics; 3 pages from www.sprintaquatics.com.*

(Continued)

*Primary Examiner*—Ajay Vasudeva
(74) *Attorney, Agent, or Firm*—GFD Patents LLC; Gerald F. Dudding

(57) ABSTRACT

A floatation method and apparatus for effectively supporting and effectively exercising a person in a liquid. A method and apparatus for effectively playing a game in a liquid. The liquid may be water or any liquid used for cleaning or moisturizing a person's skin, such as anti-oxidants, emollients, surfactants in water, or skin conditioners such as vitamin E enriched body lotions and oils.

20 Claims, 6 Drawing Sheets

U.S. PATENT DOCUMENTS

| | | | | | |
|---|---|---|---|---|---|
| 5,409,412 | A | | 4/1995 | Colon | |
| 5,520,561 | A | | 5/1996 | Langenohl | |
| 5,562,514 | A | | 10/1996 | Rowe | |
| 5,842,957 | A | * | 12/1998 | Wheeler | 482/111 |
| 5,885,123 | A | | 3/1999 | Clifford | |
| 5,921,834 | A | | 7/1999 | DeMasi | |
| 5,967,952 | A | * | 10/1999 | Bronstein et al. | 482/111 |
| 6,056,613 | A | | 5/2000 | Pike | |
| 6,132,276 | A | | 10/2000 | Leemon | |
| 6,347,971 | B1 | | 2/2002 | Berke et al. | |
| 6,402,578 | B1 | | 6/2002 | Zappitelli | |
| D474,522 | S | * | 5/2003 | Monroe | D21/803 |
| 6,659,032 | B1 | * | 12/2003 | Simon | 114/123 |
| 2003/0022766 | A1 | * | 1/2003 | Gates | 482/92 |

FOREIGN PATENT DOCUMENTS

| | | | | |
|---|---|---|---|---|
| FR | 2676176 | A1 | * | 11/1992 |
| FR | 2790676 | A1 | * | 9/2000 |
| GB | 238831 | | * | 8/1925 |
| GB | 2191705 | A | * | 12/1987 |
| JP | 08257165 | A | * | 10/1996 |
| JP | 09173499 | A | * | 7/1997 |
| JP | 09299505 | A | * | 11/1997 |
| WO | WO 2004007030 | A1 | * | 1/2004 |

OTHER PUBLICATIONS

Water dumbbells and barbells; 3 pages from Adolph Keifer & Associates Web site www.kiefer.com.*

Aquatic dumbbells and barbells; 2 pages from Ferno Performance Pools Web site www.fernoperformancepools.com/acc_dumbells.html.*

Thera-Band Aquatics, Instructional Swim Bar; www.thera-band.com/swim_bar.html; 1 page.

Nefitco.com, Spongex Swim Bar; www.nefitco.com/spongex_swim_bar.html; 1 page.

RecSupply.com; Swim Bar; www.recsupply.com/myweb/products/swimbar.htm; 2 pages.

* cited by examiner

FLOATATION APPARATUS AND METHOD

BACKGROUND OF THE INVENTION

1. Technical Field

This invention generally relates to floatation devices and methods of use, and more specifically relates to water floatation devices and methods of use.

2. Related Art

Swimming is an increasingly popular recreational activity. The popularity has been enhanced by a significant increase in the number of private and public swimming pools, lakefront homes, river front homes and ponds. People of varying swimming ability may use floatation devices, for example, as swimming aides, floatation exercisers, and as water toys.

Swimming aides and methods for their use have been disclosed where an inexperienced swimmer may be belted by a flexible connector such as a chain or a rope to an overhead floating framework in U.S. Pat. No. 1,752,630 and U.S. Pat. No. 4,798,550. A purpose of belting the inexperienced swimmer to the swimming aide may be to avoid a latent danger of swimming with a swimming aide, wherein the inexperienced swimmer may inadvertently slip away from the swimming aide when the swimmer needs the aide to remain afloat. Hereinafter, an "inexperienced swimmer" is a person who needs a floatation device operably attached to the inexperienced swimmer in order for the inexperienced swimmer to remain afloat.

Alternatively, floatation exercisers and methods for their use have been disclosed where a person needing exercise is strapped into the frame between lateral floats as in U.S. Pat. No. 4,443,204 and U.S. Pat. No. 4,722,329. A person may receive exercise by exerting pressure against the floats, such that the pressure displaces the floats beneath a surface of water.

Alternatively, floatation devices may be used as water toys. There is a need for a floatation device that may be used for various applications.

SUMMARY OF THE INVENTION

The present invention provides a floatation device, comprising: a connector; and at least one float operably attached to the connector; wherein the float includes "$L_n$" removably attached layers, and wherein "n" includes all integers 1,2,3, 4 . . . .

A second embodiment of the present invention provides a method, comprising:

providing a floatation device in a liquid, wherein the floatation device includes a connector and at least one float operably coupled to the connector, and wherein the float includes an effective number "n" of $L_n$ removably attached layers, and wherein "n" includes all integers 1,2,3,4 . . . ; and effectively supporting a person in the liquid.

A third embodiment of the present invention provides a method, comprising: providing a floatation device in a liquid, wherein the floatation device includes a connector and at least one float operably coupled to the connector, and wherein the float includes an effective number "n" of "Ln" removably attached layers, and wherein "n" includes all integers 1,2,3,4 . . . ; and effectively exercising a person in the liquid.

A fourth embodiment of the present invention provides a method, comprising: providing a floatation device in a liquid, wherein the floatation device includes a connector and at least one float operably coupled to the connector, and wherein the float includes an effective number "n" of removably attached layers, and wherein "n" includes all integers 1,2,3,4 . . . ; and effectively playing a game, wherein the float of the floatation device floats on a surface of the liquid for a portion of the playing time and the float is submerged in the liquid for a remaining portion of the playing time.

DETAILED DESCRIPTION OF THE EMBODIMENTS

Figure 1A:
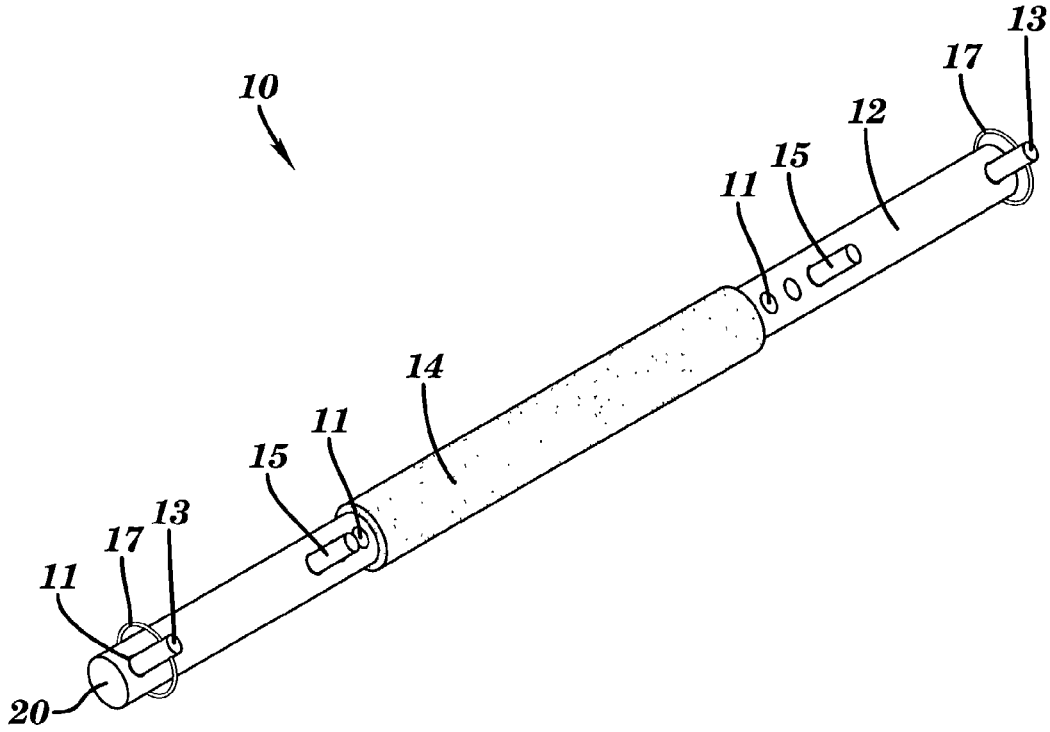
FIG. 1A depicts a connector of a floatation device, in accordance with embodiments of the present invention.

FIG. 1A depicts a connector 12 of a floatation device 10. The connector 12 may be a bar, dowel or rod made from a material such as of wood, plastic, such as polyvinyl chloride (PVC), polystyrene (PS), high density polyethylene (HDPE), high density polypropylene (HDPP) and combinations thereof. The connector 12 may have a shape such as cylindrical, cubical, pyramidal and combinations thereof. The connector 12 may include a soft outer cover 14 made of a foamed plastic such as polystyrene foam, such that the person's hands 24 may more easily grip the connector 12. For example, the connector 12 may be a piece of PVC pipe having a length from about 30 in to about 50 in. and an inside diameter from about ½ inch to about 1 inch. Optionally, a wooden dowel having an outside diameter from about 0.1 to about 0.3 inches less than the inside diameter of the PVC pipe may be inserted into the PVC pipe to reinforce it against bending. Parallel holes 11 having a diameter about 0.25 inch may be drilled into the connector 12. The holes 11 may be oriented perpendicular to a plane of the connector 12 and spaced from about 1.0 to about 3.0 inches apart. The holes 11 may be at least 0.75 inch from an end 20 of the connector 12. Pins 15 may be inserted into the holes 11 of the connector 12. The pins 15 may be made of wood or metal such as stainless steel. Alternatively, Avibank™ quick release toggle (includes pin and ring) pins 13 may be inserted into a hole 11 nearest to an end 20 of the connector 12. The toggle pins 13 are available from Bo'sun Supplies Company, P.O. Box 5535, Miller Place, N.Y. 11764.

Figure 1B:
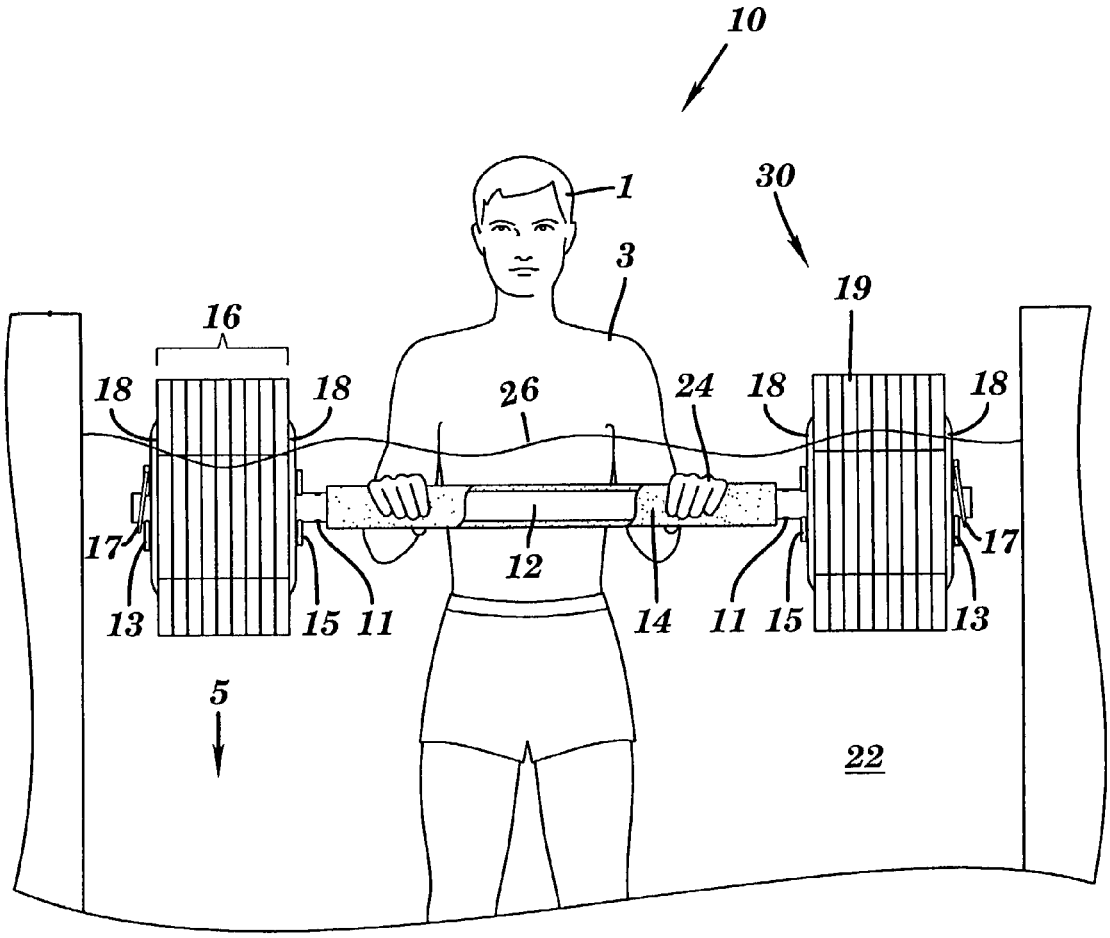
FIG. 1B depicts FIG. 1A, after floats have been placed between pins of the connector.

FIG. 1B depicts FIG. 1A, after the apparatus 10 has been placed in a liquid 22 and a person in the liquid 22 has taken the apparatus 10 in the person's hands 24, and wherein the apparatus 10 further comprises a float assembly 30, wherein the float assembly 30 has been inserted between the pins 15 and 13. Alternatively, the liquid 22 may be any body of water, such as the ocean, a lake, a pond or a swimming pool. The liquid 22 may contain any liquid such as, for example, water.

The float assembly 30, located between pins 13 and 15, comprises: at least one float 16, wherein the at least one float 16 includes a number "n" of $L_n$ removably attached layers 19, wherein "n" includes integers 1,2,3,4 . . . ; and an optional pressure distribution plate 18. The pressure distribution plate 18 may be located either between the float 16 and the pin 15, or between the float 16 and the pin 13, or the float assembly 30 may include two pressure distribution plates 18, wherein each pin 15 and pin 13 may be separated from the float 16 by a pressure distribution plate 18. A thickness of the $L_n$ removably attached layers 19 may be from about 0.1 inch to about 2.0 inches and a diameter of the layers may be from about 1 inch to about 10 inches. A purpose of the pressure distribution plate 18 may be to distribute a pressure over a surface of the float 16 and the $L_n$ removably attached layers 19 that may result when the floatation assembly 30 may be submerged in the liquid 22. The pressure distribution plate 18 may be made from materials such as polyvinyl chloride (PVC), polystyrene (PS), high density polyethylene (HDPE), high density polypropylene (HDPP) and combinations thereof. A thickness of the distribution plate may be for about 0.1 inch to about 2.0 inches and a diameter of the distribution plate 18 may be from about 1.0 inch to about 10.0 inches.

When the liquid 22 is water, the float material may be wood, plastic, such as polyvinyl chloride (PVC), polystyrene (PS), high density polyethylene (HDPE), high density polypropylene (HDPP), polystyrene foam, such as, for example Styrofoam and combinations thereof. The connector 12 may have a shape such as cylindrical, cubical, pyramidal and combinations thereof.

The float 16 may be a solid shape such as circular discs, or polygons having a number E, edges or sides 7, wherein "x" is any integer 1,2,3,4 . . . , cones, trapezoids and pyramidal solids and combinations thereof.

Figure 2:
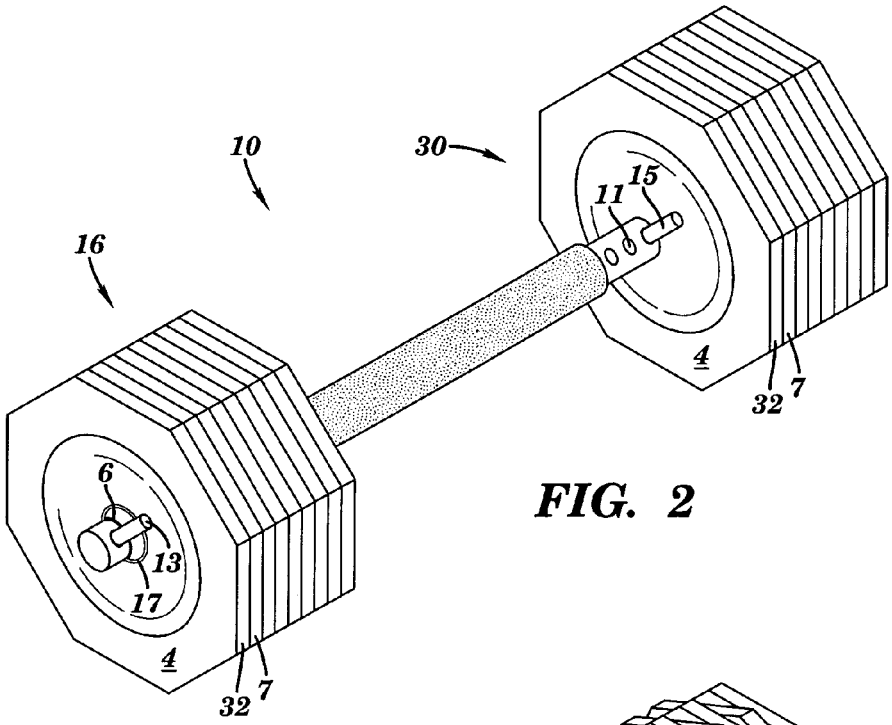
FIG. 2 depicts a float of the floatation apparatus, wherein the float has edges, in accordance with embodiments of the present invention.

FIG. 2 depicts the float 16, wherein the shape of the float 16 may be a polygon having a number $E_x$ edges or sides 7, wherein, for example, x=4. A channel 6 may be formed in the float 16 and in like manner in the optional pressure distribution plate 18 (not shown), wherein the channel 6 may be oriented orthogonal to a face 4 of the float 16 may extend from the face 4 to the opposing face of the float 16. The channel 6 in the float 16 and in the $L_n$ layers 19 of the float 16 may be from about 0.8 inch to about 1.2 inches.

In an embodiment of the present invention, the float assembly 30 may be operably coupled to the pins 15 and 13 of the connector 12 when a distance between pins 13 and 15 may be less than a combined thickness of the float assembly 30. Hereinafter, "operably coupled" or "operably coupling-"means linking the rotation of the floatation assembly 30 by the pins 15 and 13, wherein the axis of rotation of the float assembly 30 and the pins 15 and 13 may be the longitudinal axis of the connector 12, and wherein at least one float assembly 30 and the connector 12 are linked about an axis of rotation along a longitudinal axis of the connector 12.

Referring to FIG. 1B, locating the float assembly 30 between pins 15 and 13, when the distance between pins 15 and 13 is less than the combined thickness of the float assembly 30 may raise a coefficient of friction between interfaces 8, 9, and 2 that separate pins 15 and 13 from the float assembly 30, including from the optional pressure distribution plate 18. In embodiments in which the float assembly 30 is made from materials such as wood, plastic, such as polyvinyl chloride (PVC), polystyrene (PS), high density polyethylene (HDPE), high density polypropylene (HDPP) and combinations thereof, increasing the coefficient of friction between the float assembly 30 and the pins 15 and 13 results in "operably coupling" a rotation of the $L_n$ removably attached layers 19 of the float assembly 30 and the pressure distribution plate 18 directly to the rotation of the pins 15 and 13 of the connector 12.

Figure 3:
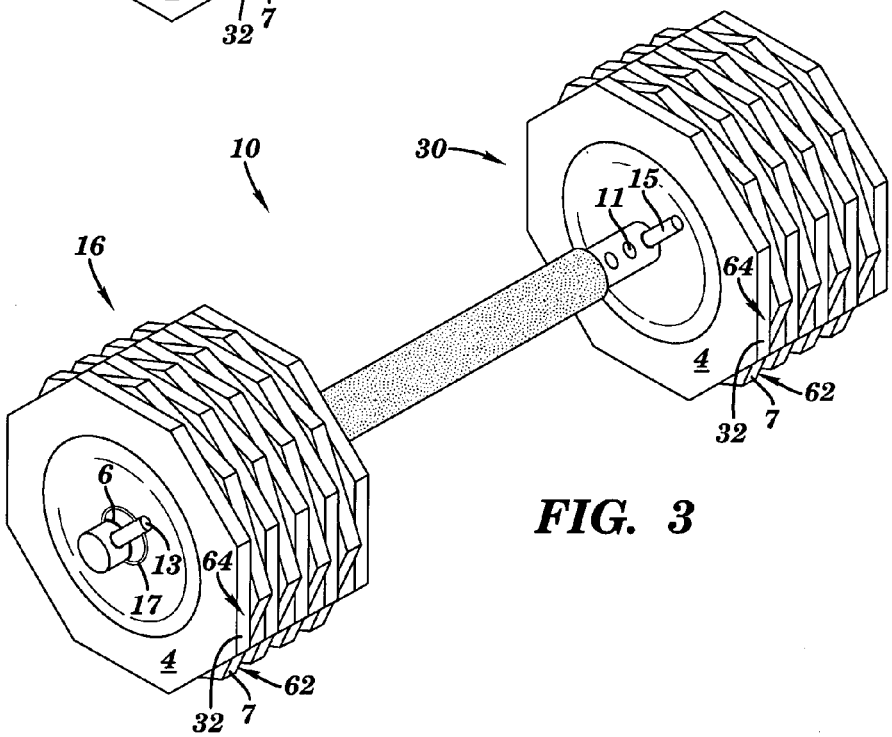
FIG. 3 depicts FIG. 2, further comprising an adjacent layer, wherein edges of the adjacent layer of the float are staggered such that no edges of the adjacent layers are coplanar.

FIG. 3 depicts FIG. 2, wherein the float 16 further comprises adjacent $L_n$ removably attached layers 62 and 64 having a number $E_x$ edges, wherein n=2 and x=4, wherein the Ln removably attached layers 62 and 64 are adjacent, and wherein an orientation of the edges 7 may not be coplanar with the edges 32. Hereinafter, a "staggered" orientation of the edges 7 and 32 of the adjacent $L_n$ removably attached layers 62 and 64 means the edges of adjacent layers are not coplanar. Referring to FIGS. 1A and B and associated text described herein, the float assembly 30 as described in FIG. 3 may be operably coupled to the pins 15 and 30 and the connector 12, wherein the edges 7 and 32 may be staggered.

Figure 4:
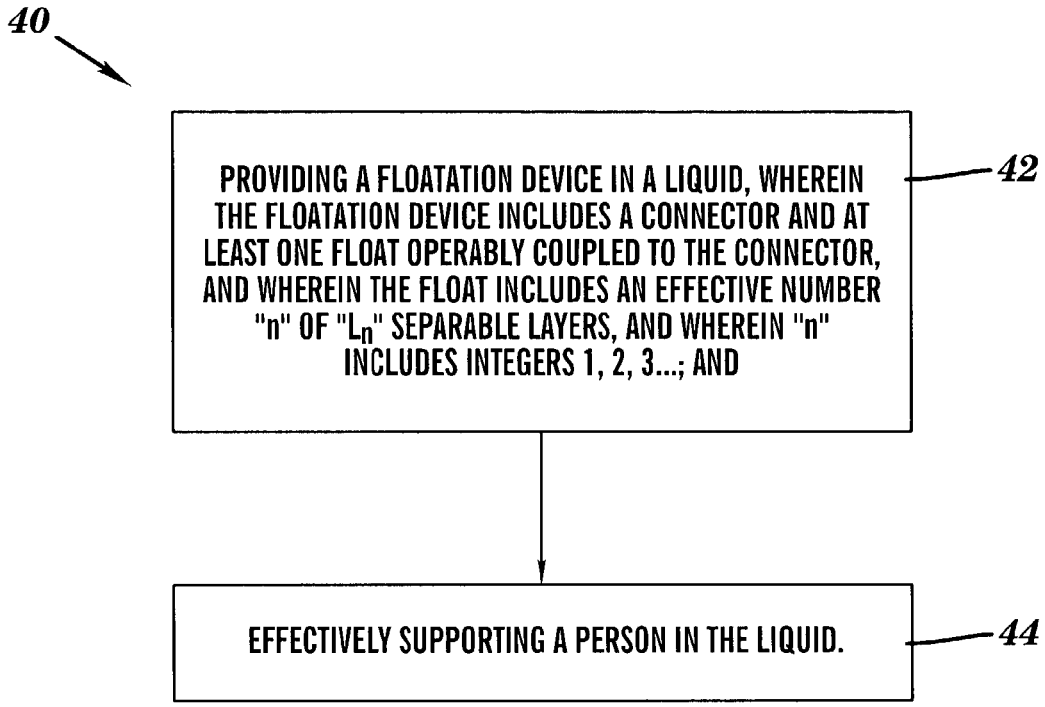
FIG. 4 depicts a method for effectively supporting a person in a liquid, in accordance with embodiments of the present invention.

FIG. 4 depicts a method 40 for effectively supporting a person in a liquid, comprising: a step 42, providing a floatation device 10 in a liquid, as depicted in FIG. 1B and described in associated text herein, wherein the floatation device includes a connector 12 and at least one float 16, operably coupled to the connector 12, and wherein the float 16 includes an effective number "n" of $L_n$ removably attached layers 19, and wherein "n" includes integers 1,2,3, 4 . . . ; and step 44, effectively supporting a person in the liquid. The liquid may be water or any liquid used for cleaning or moisturizing a person's skin, such as antioxidants, emollients, surfactants in water, or skin conditioners such as vitamin E enriched body lotions and oils.

Referring to FIG. 1B, the person enters the liquid in, for example, the liquid 22, holding the floatation device 10 in his or her hands 24, in accordance with "providing a floatation device in a liquid" step 42 of the method 40. Alternatively, the floatation device 10 may be provided in the liquid 22 prior to entry of the person.

Referring to FIG. 1B, the person may effectively maintain a portion 1 of the person's head, wherein the portion 1 may be a whole portion of the person's head and a portion 3 of the person's shoulders above a surface 26 of the liquid by pushing with the person's hands 24 against the connector 12 in a direction of an arrow 5, such that the portion 1 of the person's head and the portion 3 of the person's shoulders may be effectively supported above the surface 26 of the liquid. Hereinafter, "effectively maintaining" or "effectively supporting" a portion 1 of the person's head and a portion 3 of the person's shoulders above a surface 26 of the liquid by pushing with the person's hands 24 in a direction of the arrow 5 means maintaining or supporting the portion 1 of the person's head and the portion 3 of the person's shoulders above the surface 26 of the liquid such that the person may comfortably breathe without the liquid preventing or interfering with the breathing process such as causing coughing, choking, gaging or asphixiating.

The person may adjust a buoyancy of the floatation device 10 such that the floatation device 10 effectively supports the person in the liquid by removing the end fastener from the end 20 of the connector 12 of the floatation device 10, for example, the pin 13. Referring to FIGS. 1A and B, the float assembly 30 may be placed on the end 20 of the connector 12. For example, a pin 15 may be inserted into a hole 11 of the connector 12 and a pin 13 may be inserted into a different hole 11. The float assembly 30 comprised of a float 16 and an optional pressure distribution plate 18 having channels 6 may be located between the pins 15 and 13 by inserting the end 20 of the connector 12 into the channel 6 of the float 16 and the optional pressure distribution plate 18 as depicted in FIG. 3 and described in associated text, herein, after the pin 15 has been inserted, but before the pin 13 has been inserted. The person next adds $L_n$ removably attached layers 19 to the float 16 if increased buoyancy is required to obtain effective support, as in step 44 of the method 40. The added $L_n$ removably attached layers 19 may be placed at an end 20 of the float 16. Alternatively, the added removably attached layers 19 may be placed at each end 20 of the float 16. When the $L_n$ removably attached layers 19 are less dense than the liquid 22, each layer 19 of the float 16 contributes buoyancy to the float 16 and to the whole floatation device 10, because the float 16 is formed from combination of the $L_n$ removably attached layers 19. The pin 13 may next be inserted after the float assembly 30 has been located adjacent to the pin 15 to hold the float assembly 30 between the pins 15 and 13. Alternatively, a cap or fastener such as a compression fitting may secure the float assembly 30 to the end 20 of the connector 12. Alternatively, the connector 12 may also be threaded such that the threaded nut may be fastened to the end of the connector thereon. The compression fitting cap or fastener may be pipe caps available from Polymer Molding, Inc., Erie, Pa. 16502-2192.

If the floatation device 10 has sufficient buoyancy to provide effective support for the person in the liquid, the person may allow himself, for a brief time, to submerge a portion or all of his shoulders 3, and a portion or all of his head 1 in the liquid by relaxing his arm muscles, without losing his grip with his hands 24 on the connector 12. The person should limit such time to a length of time the person may comfortably hold his breath to avoid drowning. The person then may tighten his arm muscles and effectively support the portion or all of his head 1 and the portion or all of his shoulders 3 out of the liquid.

Referring to FIG. 3 depicting a staggered orientation of the $E_x$ edges 7 and 32 of the $L_n$ adjacent layers 19 of the float assembly 30, a person in a supine or prone position with respect to a surface of the liquid, may use the floatation device 10 to effectively support himself or herself in the presence of waves produced in the liquid, while holding the device 10 with his or her hands 24, as depicted in FIG. 1B and described in associated text herein. A purpose of the staggered orientation of the $E_x$ edges 7 and 32 of the adjacent $L_n$ removably attached layers 19 of the float assembly 30 may be to more effectively break a surface tension of the liquid as the wave approaches the person. It has been found that the person holding the floatation device 10, wherein the $E_x$ edges 7 and 32 of the adjacent $L_n$ removably attached layers 19 of the float assembly 30 have the staggered orientation is able to maintain his or her grip with the hands 24, as depicted in FIG. 1B and described in associated text herein, for longer periods than when the $E_x$ edges 7 and 32 of the adjacent $L_n$ removably attached layers 19 are coplanar.

Figure 5:
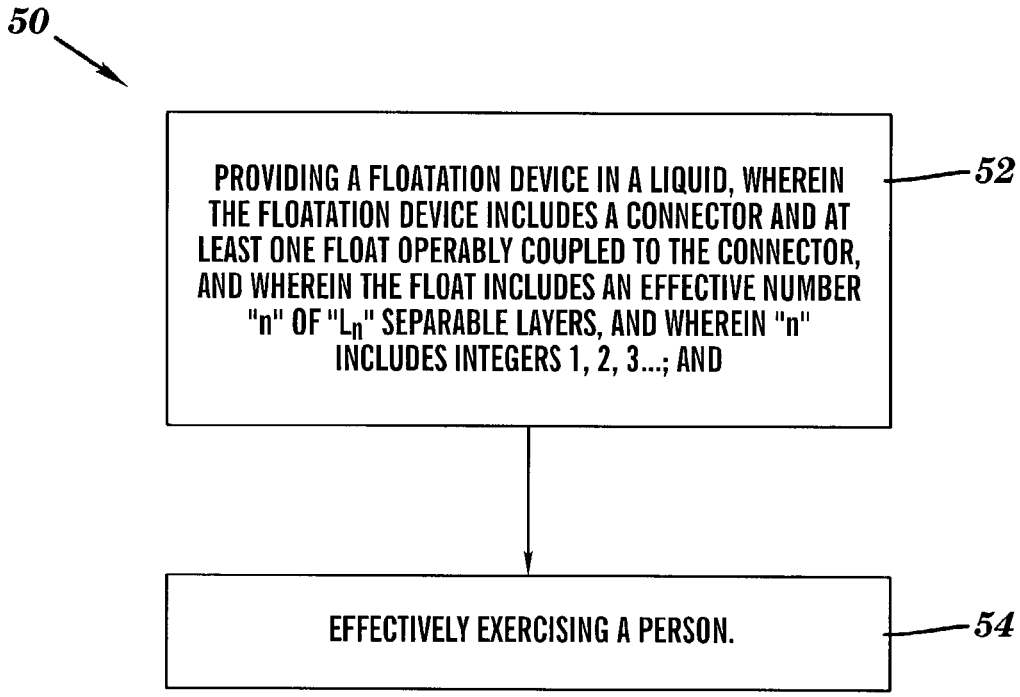
FIG. 5 depicts a method for a effectively exercising a person, in accordance with embodiments of the present invention.

FIG. 5 depicts a method 50 for effectively exercising a person in a liquid, comprising: a step 52, providing a floatation device 10 in a liquid, as depicted in FIG. 1B and described in associated text herein, wherein the floatation device includes a connector 12 and at least one float 16, operably coupled to the connector 12, and wherein the float 16 includes an effective number "n" of the $L_n$ removably attached layers 19, and wherein n includes integers 1,2,3, 4, . . . ; and step 54, effectively exercising a person in the liquid.

Referring to FIG. 1B, the person enters the liquid 22, holding the floatation device 10 in his or her hands 24, in accordance with "providing a floatation device in a liquid" step 52 of the method 50. Alternatively, the floatation device 10 may be provided in the liquid 22 prior to entry of the person. The person next adds $L_n$ removably attached layers 19 to the float 16 if increased buoyancy is required to obtain effective exercising, in accordance with step 54 of the method 50, "effectively exercising a person in the liquid."

Referring to FIG. 1B, the person may effectively exercise muscles in the arms, shoulders, chest and back (e.g. during water aerobics) by pushing the floatation device 10 either into the liquid or across a surface of the liquid with the person's hands 24. Alternatively, the person may effectively exercise muscles in the legs, thighs, stomach and back by assuming a prone or supine position, with respect to a surface of the liquid by pushing the floatation device 10 across a surface of the liquid white performing a kicking motion with the feet, legs and thighs and holding the floatation device 10 with the person's hands 24. Hereinafter, "effectively exercising" means following a course of exercise or therapy such as may be directed by a qualified physician, resulting in strengthening a person's muscles in the arms, shoulders, chest and back. Therapy may be a method of exercising prescribed by a qualified physician for strengthening an sprained, strained or similarly injured muscle of a person. For example, therapy may be a method of exercising prescribed by a qualified physician for strengthening muscles in a lumbar portion of a person's back, wherein the exercising is for strengthening a muscle in a lumbar portion of a person's back.

Referring to FIG. 1B, the person may adjust the buoyancy of the floatation device 10 such that the floatation device 10 effectively exercises the person in the liquid by adding $L_n$ removably attached layers 19 in the same manner as described for adjusting the buoyancy of the floatation device 10 for effectively maintaining or supporting a person in the liquid.

Figure 6:
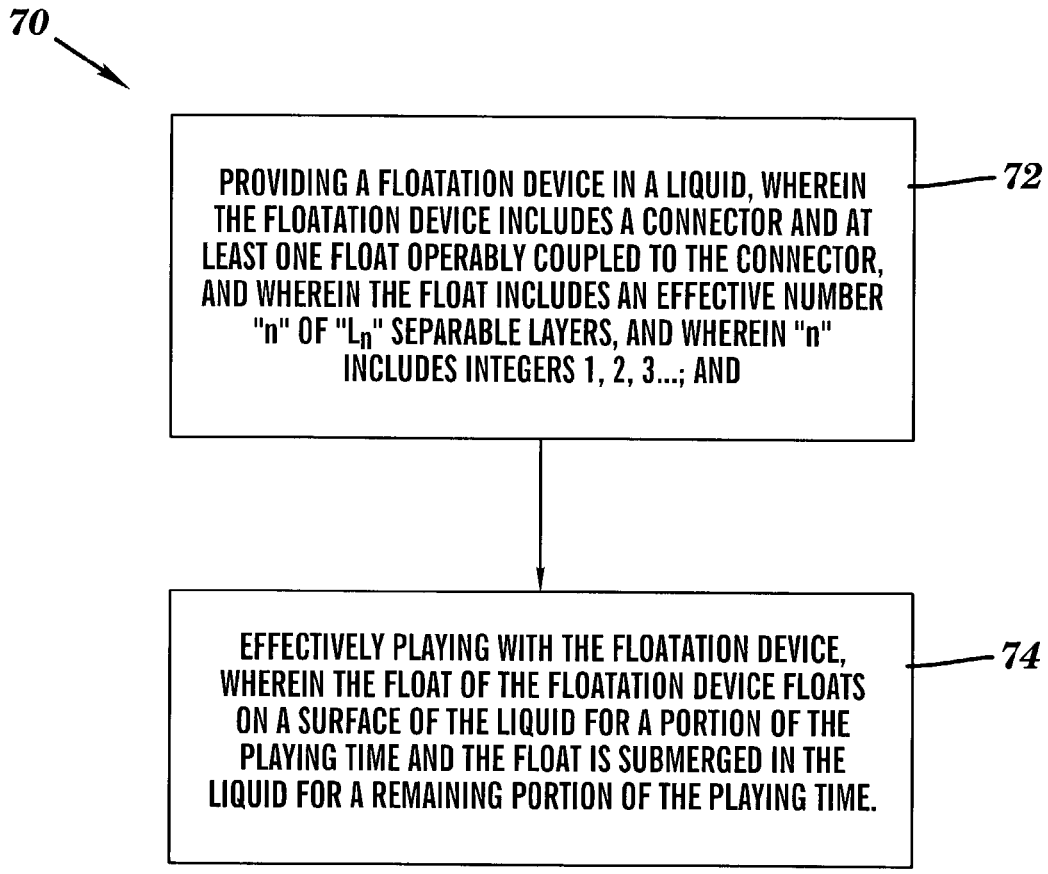
FIG. 6 depicts a method for playing with a floatation device, in accordance with embodiments of the present invention.

FIG. 6 depicts a method 70 for effectively playing a game with the floatation device 10, comprising: a step 72, providing a floatation device 10 in a liquid, as depicted in FIG. 1B and described in associated text herein, wherein the floatation device includes a connector 12 and at least one float 16, operably coupled to the connector 12, and wherein the float 16 includes an effective number "n" of $L_n$ removably attached layers 19, and wherein n includes integers 1,2,3,4 . . . ; and step 74, effectively playing with the floatation device, wherein the float of the floatation device floats on a surface of the liquid for a portion of the playing time and the float is submerged in the liquid for a remaining portion of the playing time.

Referring to FIG. 1B, the person enters the liquid in, for example, the liquid 22, holding the floatation device 10 in his or her hands 24, in accordance with "providing a floatation device in a liquid" step 72 of the method 70. Alternatively, the floatation device 10 may be provided in the liquid 22 prior to entry of the person. The person next adds $L_n$ removably attached layers 19 to the float 16 if increased buoyancy is required to obtain effective playing, in accordance with step 74 of the method 70, "effectively playing with the floatation device, wherein the float of the floatation device floats on a surface of the liquid for a portion of the playing time and the float is submerged in the liquid for a remaining portion of the playing time."

For example, a game may be played, wherein all the players except the player who is selected to hide the floatation device 10 stand in a row on a platform attached to an edge of a tank of liquid 22, facing away from the tank, waiting to dive or jump into the liquid to swim to the floatation device 10 when they see it. The selected person may be a volunteer, or a person chosen by a leader or alternatively by any appropriate method of choosing the selected person, such as whoever rolls the highest number from a throw of dice, or whoever draws the shortest straw, and so forth.

Referring to FIG. 1B, the floatation device 10 may be hidden on the bottom of the liquid 22 by the selected player pushing the floatation device 10 to a bottom of the liquid 22 with hands 24, then the selected player releases the floatation device 10 with hands 24, letting it rise to the surface 26 of the liquid 22. The selected player then returns to the group on the platform. When the selected player who hid the floatation device 10 is standing facing the liquid 22 on the platform sees the floatation device 10 on the surface 26, he alerts the others who immediately face the liquid 22, search for the floatation device 10 themselves, and all (including the person who hid the floatation device 10) who see the floatation device 10 race to fetch it. The first person who fetches the floatation device 10 may hide it on the bottom of the liquid 22 for the next round of play. The winner of the game is the person who fetches the floatation device 10 the most times.

Referring to FIG. 1B, the selected person may adjust the buoyancy of the floatation device 10 such that the selected player effectively plays with the floatation device 10 by adding $L_n$ removably attached layers 19 in accordance with the step 74 of the method 70, "effectively playing with the floatation device, wherein the float of the floatation device floats on a surface of the liquid for a portion of the playing time and the float is submerged in the liquid for a remaining portion of the playing time."

Alternatively, referring to FIG. 1B, a person may enjoy catching or riding a wave or catching or riding the surf of the liquid 22 while holding the apparatus 10 in his hands 24, wherein the person is in a prone or supine position, i.e. oriented parallel with respect to a level 26 of the liquid 22, such that the person's head 1 and shoulders 3 are supported above the level 26 of the liquid 22. Hereinafter, "catching a wave," "riding a wave," "catching the surf," or "riding the surf," entails a wave of the liquid 22 pushing the apparatus 10 as the wave moves through the liquid 22, such that the person is pulled along with the apparatus 10 because the person is operably coupled to the apparatus 10 by his or her hands 24. Hereinafter, "catching a wave," "riding a wave," "catching the surf," or "riding the surf," will be generally referred to as "surfing" with the apparatus 10.

Referring to FIG. 1B and FIG. 2, the person operably coupled to the apparatus 10 with his or her hands 24 when surfing may steer himself or herself in a non-orthogonal direction with respect to a direction of the wave by surfing in such a manner that the floats 16 of the apparatus 10 on each end 20 of the bar 12 are moved in a non-orthogonal direction with respect to the direction of the wave because in so steering, the person causes the wave to catch more surface of the float 16 on one end 20 than on the other end 20. The float 16 on the one end 20 that catches mote of the wave is advanced further than the float 16 on the other end 20 that catches less of the wave, resulting in steering the apparatus 10. The operably coupled person may be drawn by the apparatus 10 in like manner, wherein the at least two independently removable buoyant layers of the float have at least one edge and the edge has at least one surface; steering and surfing a wave, wherein the person causes the wave to catch more surface of the first float than the second float; and wherein the first float that catches more of the wave has been advanced further than the second float that catches less of the wave.

In another embodiment, the person may kick his or her feet while in a prone or supine position, i.e., parallel with respect to the level 26 of the liquid 22, while being operably coupled to the apparatus 10, such that the kicking enables the person to exert a force against the apparatus 10, propelling both the person and the apparatus 10 in a direction opposite the direction in which the persons feet are directed.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

I claim:

1. A floatation device, comprising:

an elongate connector, having an exposed portion between a first end and a second end, wherein the exposed portion is adapted to be gripped by a person;

a first float assembly operably coupled to the first end of the connector, and a second float assembly operably coupled to the second end of the connector, wherein each float assembly is inserted between pins of the connector,wherein each pin is a substantially straight rod and extends substantially transversely through at least a pair of opposing holes of the connector proximal the respective one of the ends, wherein at least one float, assembly and the connector are linked about an axis of rotation along a longitudinal axis of the connector, wherein the first and second float assemblies each include at least two independently removable buoyant layers, and wherein the number of removable buoyant layers may be varied to determine buoyancy of the floatation device.

2. The floatation device of claim 1, wherein the float material includes polystyrene foam.

3. The floatation device of claim 1, wherein the float material includes wood.

4. The floatation device of claim 1, wherein the float material is less dense than water.

5. The floatation device of claim 1, wherein each of the at least two independently removable buoyant layers of the float have at least four edges.

6. The floatation device of claim 1, wherein the pins are selected from the group consisting of wood pins, stainless steel pins and quick release toggle pins.

7. The floatation device of claim 1, wherein edges of adjacent layers of the float are staggered.

8. A method of using a floatation device by a person, comprising the steps of:

positioning the floatation device in a body of liquid, the floatation device having an elongate connector, the connector having an exposed portion between first and second ends, first and second floats coupled to respective one of the ends, each float including at least two independently removable buoyant layers, each float being inserted between pins of the connector, wherein the connector and the floats are linked about an axis of rotation along a longitudinal axis of the connector, and wherein each pin is a substantially straight rod and extends substantially transversely through at least a pair of opposing holes of the connector proximal the respective one of the ends;

adjusting the number of the removable buoyant layers on each float to select buoyancy of the floatation device, wherein said step of adjusting comprises subtracting or adding to the number of the removable buoyant layers on each float so that the person is effectively maintained or effectively supported in the body of liquid;

physically gripping the device at the exposed portion of the connector, selectively manipulating the device in the body of liquid for conducting a physical activity, wherein the physical activity comprises one or both of exercising and playing a game.

9. The method of claim 8, wherein the pins are selected from the group consisting of wood pins, stainless steel pins and quick release toggle pins.

10. The method of claim 8, wherein adjacent edges of each independently removable buoyant layer of the float are coplanar.

11. The method of claim 8, wherein adjacent edges of alternating layers of the float are coplanar.

12. The method of claim 8, wherein edges of adjacent layers of the float are staggered.

13. The method of claim 8, wherein the exercising is therapy for strengthening a strained muscle of a person.

14. The method of claim 8, wherein the exercising is for strengthening a muscle in a lumbar portion of a person's back by said person assuming a prone or supine position with respect to a surface of the body of liquid by pushing the floatation device across the surface of the liquid while performing a kicking motion with the feet, legs and thighs and holding the floatation device with the person's hands.

15. The method of claim 8, wherein the float may be a solid shape selected from the group of solid shapes consisting of circular discs, polygons having at least one edge or side cones, trapezoids, pyramidal solids and combinations thereof.

16. The method of claim 8, wherein staggering the edges breaks a surface tension of the wave.

17. The method of claim 8, wherein the step of exercising further comprises the step of moving the floatation device in the body of liquid against the selected buoyancy of the device.

18. The method of claim 8, wherein the step of playing a game further comprises the step of steering the device while surfing a wave in the body of liquid, wherein the person orients the device such that the wave catches more surface of the first float than the second float, and wherein the first float that catches more of the wave advances further than the second float that catches less of the wave.

19. The method of claim 8, wherein the at least a pair of opposing holes comprises a plurality of pair of holes.

20. The method of claim 8, wherein the liquid is water.

* * * * *